US007218867B2

(12) United States Patent
Burchette et al.

(10) Patent No.: US 7,218,867 B2
(45) Date of Patent: May 15, 2007

(54) SYSTEMS AND METHODS FOR IMAGING COMPONENTS

(75) Inventors: Lynton R. Burchette, Sanford, NC (US); Mark D. Reeves, Cary, NC (US)

(73) Assignee: Static Control Components, Inc., Sanford, NC (US)

( * ) Notice: Subject to any disclaimer, the term of this patent is extended or adjusted under 35 U.S.C. 154(b) by 153 days.

(21) Appl. No.: 10/928,058

(22) Filed: Aug. 27, 2004

(65) Prior Publication Data

US 2006/0045545 A1 Mar. 2, 2006

(51) Int. Cl.
*G03G 15/00* (2006.01)

(52) U.S. Cl. ..... 399/12

(58) Field of Classification Search ..... 399/9, 399/12, 24, 25, 27, 42, 111, 112, 119, 120, 399/262

See application file for complete search history.

(56) References Cited

U.S. PATENT DOCUMENTS 6,909,856 B2 * 6/2005 Crichton ..... 399/12

* cited by examiner

*Primary Examiner*—Hoang Ngo

(57) ABSTRACT

A cartridge chip for use with a first type of imaging cartridge and a second type of imaging cartridge comprises a controller and a resistive element connected between the controller and a reference potential, the cartridge chip adapted for operation in a first mode of operation compatible with the first type of imaging cartridge when the controller detects the reference potential through the resistive element, the cartridge chip adapted for operation in a second mode of operation compatible with the second type of imaging cartridge when the controller cannot detect the reference potential through the resistive element.

17 Claims, 2 Drawing Sheets

SYSTEMS AND METHODS FOR IMAGING COMPONENTS

BACKGROUND

The present invention generally relates to manufacturing and repairing replaceable imaging components, and more particularly to techniques for providing a cartridge chip comprising a memory element adapted for selectably operating in different types of imaging cartridges.

In the imaging industry, there is a growing market for the remanufacture and refurbishing of various types of replaceable imaging components such as toner cartridges, drum cartridges, ink cartridges, and the like. Imaging cartridges, such as toner cartridges, once spent, are unusable for their originally intended purpose. Without a refurbishing process, they would simply be discarded, even though the cartridge itself may still have potential life. As a result, techniques have been developed specifically to address this issue. These processes may entail, for example, the disassembly of the various structures of the cartridge, replacing toner or ink, cleaning, adjusting or replacing any worn components and reassembling the cartridge.

Some imaging cartridges may include a cartridge chip having a memory device which is used to store data related to the cartridge or the imaging device. An imaging device may include laser printers, copiers, inkjet printers, facsimile machines and the like, for example. The imaging device, such as the printer, reads this data stored in the memory device to determine certain printing parameters and communicate information to the user. For example, the memory may store the model number of the cartridge so that the printer may recognize the cartridge as one which is compatible with that particular printer. Additionally, by way of example, the cartridge memory may store the number of pages that can be expected to be printed from the imaging cartridge during a life cycle of the cartridge and other useful data. The imaging device may also write certain data to the memory device, such as the amount of toner remaining in the cartridge. Other data stored in the cartridge may relate to the usage history of the imaging cartridge.

For a given imaging device such as a printer, the appropriate cartridges may be available in a variety of styles. Lexmark, for example, may sell a "Use and Return" cartridge and a "Non Use and Return" cartridge for a given printer model. Both of these types of cartridges interface with the printer in different ways and may include differing physical characteristics, such as different encoder wheels. Different functionality may need to be provided the cartridge chip for each of these types of cartridges. Previously, a single cartridge chip having a switch was utilized for both types of cartridges. Based on the setting of the switch, the cartridge chip would be compatible with one of the cartridge types. However, these switches increase both the cost and size of the cartridge chip. Thus, it would be advantageous to provide systems and methods for selecting a mode of operation for a cartridge chip which is user friendly, cost effective and minimizes the space consumed on the cartridge chip.

SUMMARY

In one aspect of the present invention a method of configuring an imaging cartridge includes determining if the imaging cartridge is a first type of imaging cartridge or a second type of imaging cartridge; providing a cartridge chip comprising a controller and a resistive element connected between the controller and a reference potential, with the cartridge chip adapted for operation in a first mode of operation compatible with the first type of imaging cartridge when the controller detects the reference potential through the resistive element and adapted for operation in a second mode of operation compatible with the second type of imaging cartridge when the controller cannot detect the reference potential through the resistive element; removing the resistive element from the cartridge chip if the imaging cartridge is the second type of imaging cartridge; and attaching the cartridge chip to the imaging cartridge.

In another aspect of the present invention, a cartridge chip for use with a first type of imaging cartridge and a second type of imaging cartridge comprises a controller and a resistive element connected between the controller and a reference potential, the cartridge chip adapted for operation in a first mode of operation compatible with the first type of imaging cartridge when the controller detects the reference potential through the resistive element, the cartridge chip adapted for operation in a second mode of operation compatible with the second type of imaging cartridge when the controller cannot detect the reference potential through the resistive element.

In another aspect of the present invention, a method of configuring a cartridge chip for an imaging cartridge comprises providing the cartridge chip comprising a controller and a resistive element connected between the controller and a reference potential, the cartridge chip adapted for operation in a first mode of operation compatible with a first type of imaging cartridge when the controller detects the reference potential through the resistive element, the cartridge chip adapted for operation in a second mode of operation compatible with a second type of imaging cartridge when the controller cannot detect the reference potential through the resistive element; and instructing a user to remove the resistive element from the cartridge chip if the imaging cartridge is the second type of imaging cartridge.

In another aspect of the present invention, a cartridge chip for use with a first type of imaging cartridge and a second type of imaging cartridge comprises a controller and a resistive element connected between the controller and a reference potential, the cartridge chip adapted for operation in a first mode of operation compatible with the first type of imaging cartridge when the controller detects the reference potential through the resistive element, the cartridge chip adapted for operation in a second mode of operation compatible with the second type of imaging cartridge when the controller does not detect the reference potential through the resistive element.

In another aspect of the present invention, a cartridge chip for use with a first type of imaging cartridge and a second type of imaging cartridge comprises a controller comprising a port; and a resistive element connected between the port and a reference potential, the cartridge chip for operating in a first mode of operation compatible with the first type of imaging cartridge when the controller detects the presence of the resistive element, the cartridge chip adapted for operation in a second mode of operation compatible with the second type of imaging cartridge when the controller does not detect the presence of the resistive element.

A more complete understanding of the present invention, as well as further features and advantages of the invention, will be apparent from the following detailed description and the accompanying drawings.

DETAILED DESCRIPTION

The following detailed description of preferred embodiments refers to the accompanying drawings which illustrate specific embodiments of the invention. In the discussion that follows, specific systems and techniques for repairing, manufacturing or remanufacturing a toner cartridge including a memory element are disclosed. Other embodiments having different structures and operations for the repair, remanufacture and operation of other types of replaceable imaging components and for various types of imaging devices, such as laser printers, inkjet printers, copiers, facsimile machines and the like do not depart from the scope of the present invention.

Figure 1:
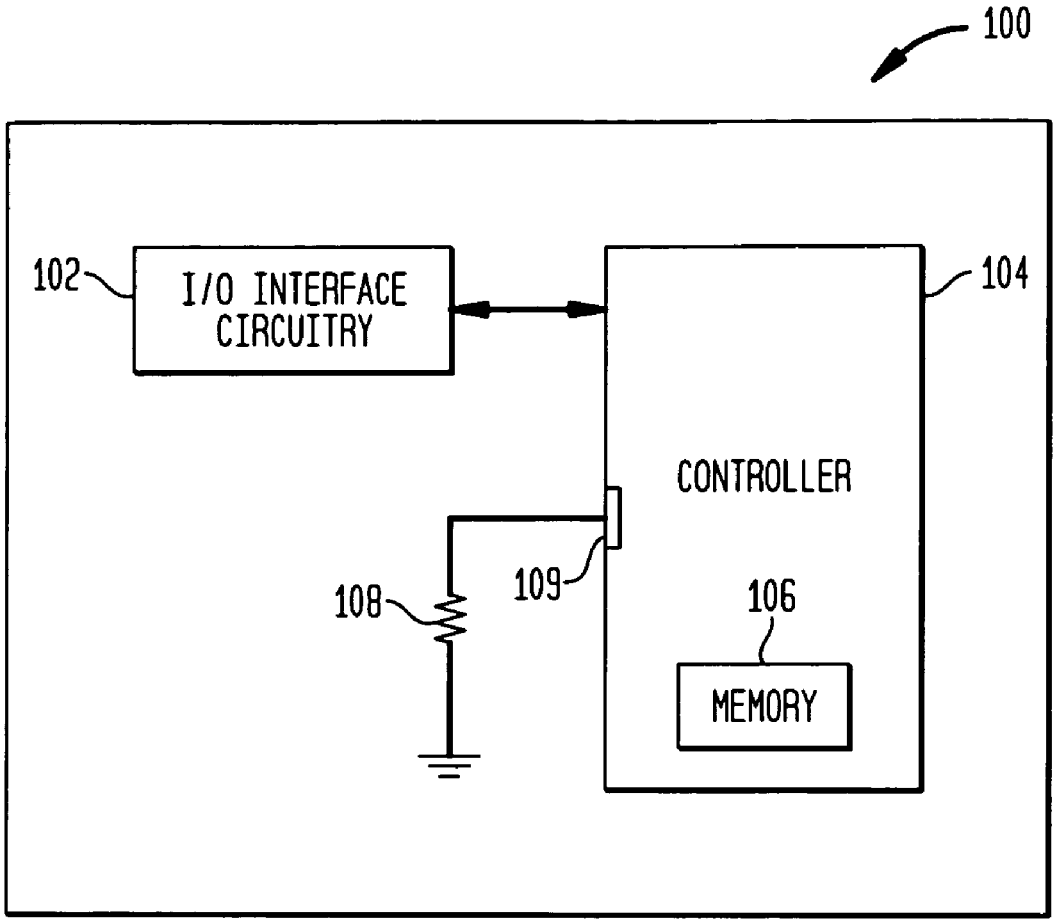
FIG. 1 shows a functional block diagram of a cartridge chip in accordance with the present invention.

FIG. 1 shows a functional block diagram of a cartridge chip 100 in accordance with the present invention. The cartridge chip 100 may suitably include input/output (I/O) interface circuitry 102, a controller 104, and a memory 106. The cartridge chip 100 also includes a resistor 108 connected between an input port 109 of the controller 104 and electrical ground. Alternately, the resistor 108 may be connected between the input port 109 of the controller 104 and a positive or negative voltage reference potential. In one aspect, the resistor 108 may be a surface mount type of resistor. The I/O interface circuitry 102 is communicatively connected to the controller 104 and provides the appropriate electronic circuitry for the controller 104 to communicate with an imaging device, such as a printer. As an example, for imaging devices which communicate utilizing radio frequency (RF), the I/O interface circuitry 102 may include a radio frequency (RF) antenna and associated circuitry, and for a direct wired connection to imaging devices the I/O interface circuitry 102 may include one or more contact pads, or the like. The controller 104 controls the operation of the cartridge chip 100 and provides a functional interface to the memory 106.

The controller 104 controls the reading of data from and the writing of data to the memory 106. The data read from or written to the cartridge chip 100 may include a printer type, cartridge serial number, the number of revolutions performed by the organic photo conductor (OPC) drum (drum count), the manufacturing date, number of pages printed (page count), percentage of toner remaining, yield (expected number of pages), color indicator, toner-out indicator, toner low indicator, virgin cartridge indicator (whether or not the cartridge has been remanufactured before), job count (number of pages printed and page type), and any other data that may be stored on the cartridge memory element.

Figure 2:
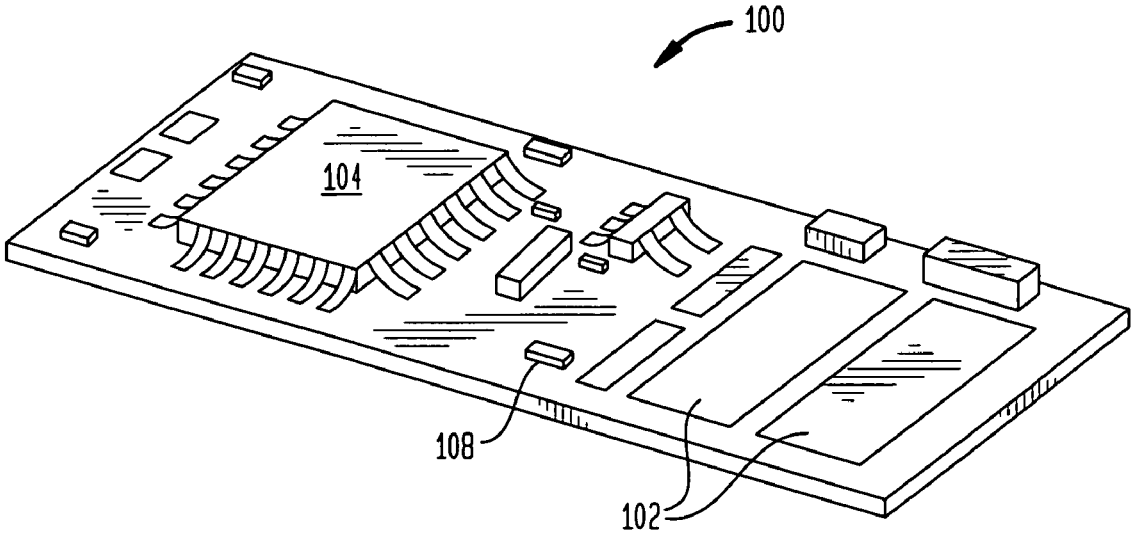
FIG. 2 shows a perspective view of a cartridge chip in accordance with the present invention.

The controller 104 may be suitably implemented as a custom or semi-custom integrated circuit, a programmable gate array, a microprocessor executing instructions from the memory 106 or other memory, a microcontroller, or the like. Additionally, the controller 104, the memory 106 and/or the I/O interface circuitry 102 may be separated or combined in one or more physical modules. These modules and the resistor 108 may be suitably mounted to a printed circuit board to form the cartridge chip 100. FIG. 2 shows a perspective view of the cartridge chip 100 in accordance with the present invention.

In a preferred embodiment of the present invention, the cartridge chip 100 may advantageously operate with either of two types of cartridges for a given printer or imaging device by operating in either of two modes of operation. For example, a first mode of operation may be compatible with a "Prebate" cartridge sold by Lexmark for a particular printer and a second mode of operation may be compatible with a "Non-Prebate" cartridge sold by Lexmark for that same printer. Continuing this example, when operating in the first mode of operation the controller 104 will return one value to the printer when the printer attempts to read a predetermined memory location in the memory 106, and when operating in the second mode of operation the controller 104 will return a different value to the printer when the printer attempts to read the same predetermined memory location. These differing values in the predetermined memory location may be based on the differences between the encoder wheels of the different cartridge types. The value returned by the controller 104 operating in the first mode of operation is compatible with encoder wheel of a first cartridge type and the value returned by the controller 104 operating in the second mode of operation is compatible with the encoder wheel of a second cartridge type. The printer may compare the read value to the type of encoder wheel sensed by the printer to ensure that the correct encoder wheel is being used with the correct cartridge chip. Stated another way, the cartridge chip 100 may imitate a "Prebate" cartridge chip when installed on a "Prebate" cartridge and a "Non-Prebate" chip when installed on a "Non-Prebate" cartridge.

To facilitate such functionality, the controller 104 determines the appropriate mode of operation based on the presence or absence of the resistor 108. Each cartridge chip 100 may be manufactured with the resistor 108 in place on the cartridge chip 100 and then optionally removed prior to installation on the imaging cartridge based on the type of the imaging cartridge. The controller 104 may suitably read the input port 109 to determine the presence or absence of the resistor 108. Preferrably, the input port 109 includes internal pull-up circuitry which prevents the input port 109 from floating by pulling the input voltage to a predetermined value when the resistor 108 is not present. If the controller 104 reads a logic 0 (due to the ground connection through the resistor 108) on the port 109, then the controller 104 will operate in one mode compatible with a first type of imaging cartridge, and if the controller 104 reads a logic 1 (due to the internal pull-up circuitry), then the controller 104 will operate in another mode compatible with a second type of imaging cartridge. The resistor 108 is preferably 1 kohms to 5 kohms. The resistor 108 is preferably a surface mount resistor which may be removed from the cartridge chip by a user prior to installing the cartridge chip 100 on the appropriate type of cartridge. The resistor 108 may be removed by pliers or other mechanical means.

Optionally, if internal pull-up circuitry is not present on the input port 109, an external resistor may be deployed for the same purpose.

In an alternate embodiment, the resistor 108 may be connected between the input port 109 and a positive or negative reference voltage potential.

In another aspect of the present invention, additional resistors may be suitably connected to additional input ports of the controller 104 to provide for further modes of operation. For example, for two resistors connected to two input ports, the controller 104 may determine up to four modes of operation, if desired.

In an alternate embodiment of the present invention, the resistor 108 may remain in place on the cartridge chip 100 and a portion of a conductive element connecting the resistor 108 to the input port 109 or to the reference potential may be removed or cut.

In another aspect of the present invention, the input port 109 may be connected to the reference potential utilizing conductive ink. A portion of the conductive ink connecting the input port 109 to the reference potential may be removed or cut.

Although specific embodiments have been illustrated and described herein, those of ordinary skill in the art appreciate that any arrangement which is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

What is claimed is:

1. A method of configuring a cartridge chip for an imaging cartridge comprising:

providing the cartridge chip comprising a controller and a resistive element connected between the controller and a reference potential, said cartridge chip adapted for operation in a first mode of operation compatible with a first type of imaging cartridge when the controller detects the reference potential through the resistive element, said cartridge chip adapted for operation in a second mode of operation compatible with a second type of imaging cartridge when the controller cannot detect the reference potential through the resistive element; and instructing a user to remove the resistive element from the cartridge chip if the imaging cartridge is the second type of imaging cartridge.

2. The method of claim 1 wherein the cartridge chip comprises a memory element and wherein:

when the cartridge chip is operating in the first mode of operation, the cartridge chip returns a first value when an imaging device performs a read from a predetermined memory location in the memory element; and when the cartridge chip is operating in the second mode of operation, the cartridge chip returns a second value when the imaging device performs a read from the predetermined memory location in the memory element, said second value differing from the first value.

3. The method of claim 2 wherein both the first type of imaging cartridge and the second type of imaging cartridge are adapted for use in the same model of imaging device.

4. The method of claim 3 further comprising:

attaching the cartridge chip to the imaging cartridge.

5. The method of claim 4 wherein the first value is compatible with a first type of encoder wheel of the first type of imaging cartridge and the second value is compatible with a second type of encoder wheel of the second type of imaging cartridge.

6. A cartridge chip for attachment to a first type of imaging cartridge or a second type of imaging cartridge, the cartridge chip comprising:

a controller and a resistive element connected between the controller and a reference potential, said cartridge chip adapted for operation in a first mode of operation compatible with the first type of imaging cartridge when the controller detects the reference potential through the resistive element, said cartridge chip adapted for operation in a second mode of operation compatible with the second type of imaging cartridge when the controller does not detect the reference potential through the resistive element.

7. The cartridge chip of claim 6 wherein the resistive element is adapted for removal from the cartridge chip if the imaging cartridge is the second type of imaging cartridge.

8. The cartridge chip of claim 7 wherein the cartridge chip comprises a memory element and wherein:

when the cartridge chip is operating in the first mode of operation, the cartridge chip returns a first value when an imaging device performs a read from a predetermined memory location in the memory element; and when the cartridge chip is operating in the second mode of operation, the cartridge chip returns a second value when the imaging device performs a read from the predetermined memory location in the memory element.

9. The cartridge chip of claim 8 wherein both the first type of imaging cartridge and the second type of imaging cartridge are adapted for use in the same model of imaging device.

10. A cartridge chip for attachment to a first type of imaging cartridge or a second type of imaging cartridge, the cartridge chip comprising:

means for controlling the cartridge chip; and a resistive element connected between the controller and a reference potential, wherein said means for controlling the cartridge chip is adapted for operation in a first mode of operation compatible with the first type of imaging cartridge when the means for controlling the cartridge chip detects the reference potential through the resistive element, wherein said means for controlling the cartridge chip is adapted for operation in a second mode of operation compatible with the second type of imaging cartridge when the means for controlling the cartridge chip does not detect the reference potential through the resistive element.

11. The cartridge chip of claim 10 wherein the resistive element is adapted for removal from the cartridge chip if the imaging cartridge is the second type of imaging cartridge.

12. The cartridge chip of claim 11 wherein the cartridge chip comprises a memory element and wherein:

when the means for controlling the cartridge chip is operating in the first mode of operation, the cartridge chip returns a first value when an imaging device performs a read from a predetermined memory location in the memory element; and when the means for controlling the cartridge chip is operating in the second mode of operation, the cartridge chip returns a second value when the imaging device performs a read from the predetermined memory location in the memory element.

13. The cartridge chip of claim 12 wherein both the first type of imaging cartridge and the second type of imaging cartridge are adapted for use in the same model of imaging device.

14. A cartridge chip for attachment to a first type of imaging cartridge or a second type of imaging cartridge, the cartridge chip comprising:

a controller comprising a port; and a resistive element connected between the port and a reference potential, said cartridge chip for operating in a first mode of operation compatible with the first type of imaging cartridge when the controller detects the presence of the resistive element, said cartridge chip adapted for operation in a second mode of operation compatible with the second type of imaging cartridge when the controller does not detect the presence of the resistive element.

15. The cartridge chip of claim 14 wherein the resistive element is adapted for removal from the cartridge chip.

16. The cartridge chip of claim 14 wherein the cartridge chip comprises a memory element and wherein:

when the cartridge chip is operating in the first mode of operation, the cartridge chip returns a first value when an imaging device performs a read from a predetermined memory location in the memory element; and when the cartridge chip is operating in the second mode of operation, the cartridge chip returns a second value when the imaging device performs a read from the predetermined memory location in the memory element.

17. The cartridge chip of claim 14 wherein both the first type of imaging cartridge and the second type of imaging cartridge are adapted for use in the same model of imaging device.

* * * * *